US005678873A

United States Patent [19]

Robinson

[11] Patent Number: 5,678,873

[45] Date of Patent: Oct. 21, 1997

[54] SNOWMOBILER'S AVALANCHE SHOVEL

[76] Inventor: Lyle Robinson, 5354 S. 5200 W., Kearns, Utah 84118

[21] Appl. No.: 706,468

[22] Filed: Sep. 3, 1996

[51] Int. Cl.[6] ..... E01H 5/02

[52] U.S. Cl. ..... 294/51; 294/57; 224/408

[58] Field of Search ..... 294/49, 51, 54.5, 294/57, 59; 224/403, 405, 408

[56] References Cited

U.S. PATENT DOCUMENTS

| | | | |
|---|---|---|---|
| 1,478,204 | 12/1923 | Cooney et al. | 294/51 |
| 3,226,149 | 12/1965 | McJohnson | 294/51 |
| 3,980,217 | 9/1976 | Yochum | 224/535 |
| 3,986,574 | 10/1976 | Irvine | 224/408 |
| 4,009,853 | 3/1977 | Lile | 224/403 |
| 4,700,420 | 10/1987 | Belanger | 242/84.1 |
| 4,993,768 | 2/1991 | Ewen | 254/266 |
| 5,048,883 | 9/1991 | Waluk | 294/57 |
| 5,063,628 | 11/1991 | Campbell | 254/344 |
| 5,103,520 | 4/1992 | Mazzo | 74/545 |
| 5,533,768 | 7/1996 | Mitchell | 294/54.5 |

*Primary Examiner*—Dean Kramer

*Attorney, Agent, or Firm*—Patent & Trademark Services, Inc.; Joseph H. McGlynn; Thomas Zack

[57] ABSTRACT

A two piece shovel mounted on a vehicle such as snowmobile. A mounting cover extends over part of the vehicle's transmission and serves to support the shovel head and its attached upper handle section and the lower separated handle section. Cover prongs may engage holes in the handle sections along with several fasteners to provide this support. The shovel's head also overlaps and protects part of the vehicle's transmission. A series of holes in the upper handle section serve as receptors for a spring biased pin located on the lower handle section. By selectively engaging these holes with the pin, the total assembled handle length may be adjusted. Additional features include a lower handle compartment for emergency items and inscribed emergency procedures on the shovel head's back.

5 Claims, 1 Drawing Sheet

FIG. 1
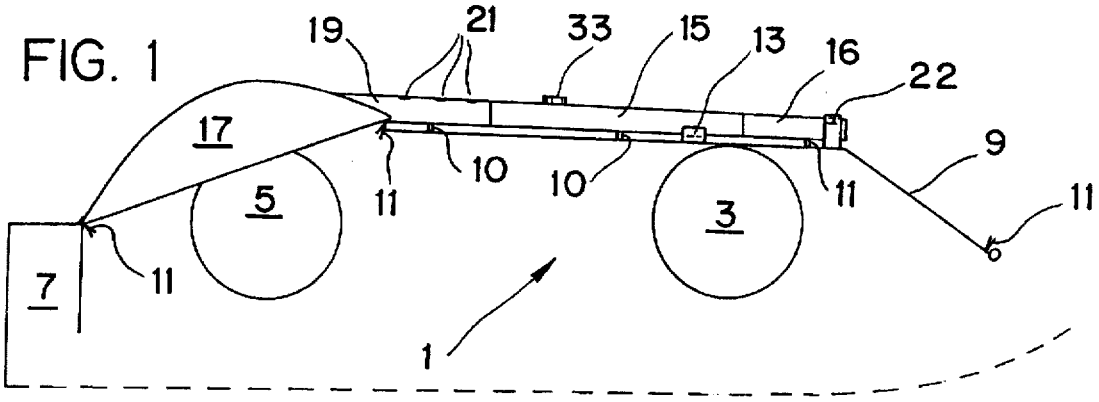
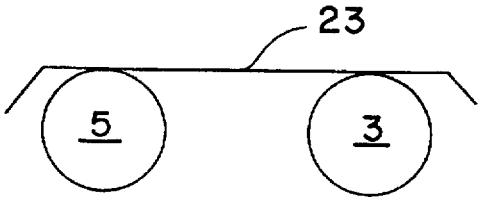
FIG. 2
PRIOR ART
FIG. 3
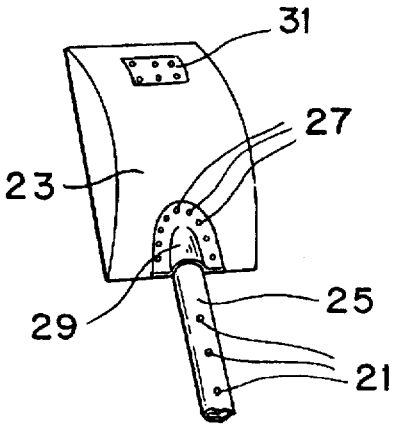
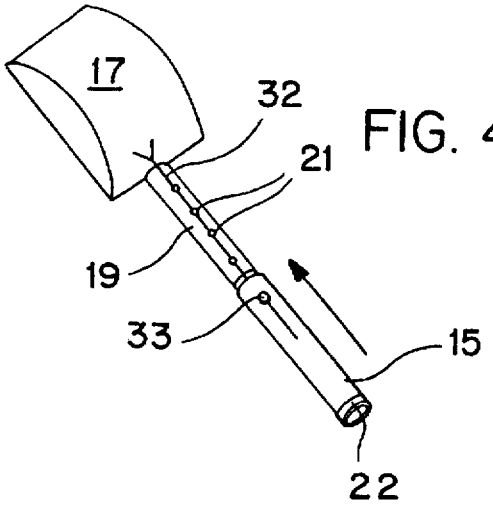
FIG. 4
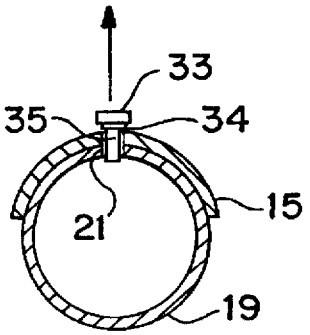
FIG. 5

SNOWMOBILER'S AVALANCHE SHOVEL

BACKGROUND OF THE INVENTION

Safety concerns have suggested to many users of snowmobiles and other vehicles used in winter time weather of the necessity of carrying shovels with them. For many of these vehicles carrying a shovel, even a small one, presents a space problem. Where can the shovel and its handle be stored such that it will not be forgotten and yet still be easily accessible to the users. The present invention not only provides for a convenient vehicle storage place for a two-piece shovel but it also acts as a protective shield for the vehicle's clutch.

DESCRIPTION OF THE PRIOR ART

Many of the prior art handle tools, including shovels, have multiple uses. For example, in U.S. Pat. No. 4,700,420 to Belanger, a multi-purpose camping tool including a trenching spade is disclosed. U.S. Pat. No. 4,993,768 to Ewen discloses a combined snow shovel and utility device usable during emergency winter situations. In U.S. Pat. No. 5,063,628 to Campbell a survival device including a trenching tool. And in U.S. Pat. No. 5,103,520 to Mazzo a multi-purpose tool is disclosed which includes a spade/trowel. None, however, are known to provide for a disassembable shovel which can be conveniently stored on a snowmobile, or the like, and also provide protection for its working parts as described in this specification.

SUMMARY OF THE INVENTION

A portable two piece shovel which can be disassembled and stored on a vehicle, especially a snowmobile, to shield some of the vehicle's working parts. The two pieces, the retractable handle and shovel sections, can be joined together for assembly and the handle may expand or retract. Appropriate fasteners and vehicle mounts permit the attachment of the shovel sections to the vehicle.

It is the primary object of the present invention to provide for an improved portable disassemble shovel which can be mounted on a vehicle.

Another object is to provide for such a shovel specifically adapted for mounting to a snowmobile.

These and other objects and advantages of the present invention will become apparent to readers from a consideration of the ensuing description and the accompanying drawings.

BRIEF DESCRIPTION OF THE DRAWINGS

FIG. 1 is a side view of the invention's preferred embodiment mounted on a vehicle.

FIG. 2 is a side view of a prior art typical clutch cover for a snowmobile.

FIG. 3 shows a top perspective view of one shovel head/handle embodiment.

FIG. 4 is a top perspective view of another shovel head/handle embodiment showing the lower handle section being inserted over the upper handle section.

FIG. 5 is a cross sectional view of the assembled upper and lower handle section.

DESCRIPTION OF THE PREFERRED EMBODIMENT

FIG. 1 is a side view of the invention's preferred embodiment mounted on a snowmobile vehicle 1. Typically such vehicle's have a transmission with a secondary clutch 3 and a primary clutch 5 and some type of main support structure 7. A modified clutch cover 9 extends over the secondary clutch 3 and is attached to the vehicle by two or more fastening pins 11 such as manually removable clevis pins. Additional male prongs 10 (three shown) extending upwardly from the cover may be used to join with female hole receptors in the handle to insure a firm mount. Forming part of the cover 9 is a handle mount 13 which fits around the mount handle lower section 15. This lower handle section may have an enclosed interior hollow lower portion or end chamber 16 as represented by the dotted lines.

Extending partially over the primary clutch 5 is the concave shovel head portion 17 which is attached to the vehicle's main support by one of the pins 11. This shovel head overlay permits the primary clutch to be protected from deleterious substances such as engine oil or grease and grim. Rigidly attached to the shovel head 17 is an extending upper handle section 19 having a series of upper separated holes 21. The upper handle 19 is slightly smaller in it outside surface diameter than the outer surface of the lower handle 15 such that it may fit under it in a telescoping manner. A screw off lower handle end knob 22 can be used to permit entry to the section's hollow lower portion in which matches or other emergency items such as first-aid kit, flashlight etc., may be stored.

FIG. 2 is a prior art view of a typical snowmobile clutch cover 23. Such covers would extend over the secondary and primary clutches of a snowmobile. When the FIG. 1 embodiment is used, cover 23 would be replaced by the modified clutch cover 9.

FIG. 3 shows a top perspective view of one shovel head/handle embodiment. In this embodiment the shovel's concave head 23 is rigidly joined to the upper handle section 25 by a series of rivets 27 which form a semi-circular pattern on its back surface and extend through a reinforcement back plate 29. Inscribed written or illustrated, or both, emergency procedures may also may be located on the back of the shovel's head and contained in area 31.

FIG. 4 is a top perspective view of another shovel head/handle embodiment showing the lower handle section 15 being inserted over the upper handle section 19. This embodiment is essentially the same as that embodiment shown in FIG. 1 except that a strengthening seam 32 has been welded down the middle of the upper handle's section 19. The lower section 15 is slightly larger in outside dimensions such that it may fit over the smaller complementarily shaped upper handle section 19. When this occurs, the holes 21 can be engaged by a spring loaded knob 33 located on the extending lower handle which extends through the handle section 15. The FIG. 5 is a cross sectional view of the assembled upper 19 and lower handle section 15 best illustrates this relationship. By retracting the spring load knob 33 upward, in the direction of the arrow, against the spring's 34 downward biasing action the knob's lower end 35 becomes disengaged from one of the holes 21 in the handle's upper section 19. This allows a user to increase or decrease the total handle length for both joined handle sections.

Many materials can be used to make the different components of this invention. The shovel head and handle should be made of a lightweight moisture resistant strong material such as aluminum, lightweight plastic or carbon fiber. In use, the mounted shovel is released from the snowmobile by pulling the fastening pins 11 out and lifting the prong/hole mounted shovel handle sections from the cover 9. The overlapping lower handle section 15 is mounted to the upper handle section 19 by aligning and retracting the biased pin spring end 35 and then releasing knob 33. This action locks the two handle sections together at the desire total shovel handle length.

Although the Snowmobiler's Avalanche Shovel and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A disassemble shovel adapted to be mounted to a vehicle comprising:

a shovel head having an attached upper shovel handle section, said upper section having a series of mounting receptors locator along its length;

a lower handle section having means for individually engaging any one of said series of upper handle section mounting receptors; and means for mounting said shovel head and handle sections to a vehicle, said means including a cover which mounts over part of the vehicle's transmission such that the shovel's head forms a protective barrier for at least part of the transmission.

2. The shovel as claimed in claim 1, wherein said mounting means also includes prongs extending from said cover which engage holes in the handle sections and a plurality of separated manually removable fasteners.

3. The shovel as claimed in claim 2, wherein said series of mounting receptors in the upper handle section includes a series of spaced holes and said lower handle section has means for selectively engaging any one of these receptor holes including a biased retractable pin whereby the total length of the joined handle section may be adjusted.

4. The shovel as claimed in claim 3, wherein said lower handle section has an end cavity closed by an openable end piece to permit the storage therein of emergency items.

5. The shovel as claimed in claim 4, also including emergency procedures inscribed into the surface of the shovel's head.

* * * * *